US005540364A

United States Patent [19]

Krieger et al.

[11] Patent Number: 5,540,364

[45] Date of Patent: Jul. 30, 1996

[54] ARTICLE CARRIER

[76] Inventors: Julian Z. Krieger, 0173 Meadow Dr.; Padraic J. Cassidy, 106 Tally Ho Ct., both of Dillon, Colo. 80435

[21] Appl. No.: 298,972

[22] Filed: Sep. 2, 1994

[51] Int. Cl.[6] ..... A45F 4/02

[52] U.S. Cl. ..... 224/153; 224/240; 224/581; 224/637; 224/645; 224/666; 224/917

[58] Field of Search ..... 224/151, 153, 224/209, 210, 211, 212, 214, 215, 216, 224, 240, 184; 2/84, 94

[56] References Cited

U.S. PATENT DOCUMENTS

| | | | |
|---|---|---|---|
| 4,518,107 | 5/1985 | Amos et al. | 224/215 |
| 4,792,073 | 12/1988 | Jacober | 224/202 |
| 4,934,573 | 6/1990 | Jaeger | 224/210 |
| 4,982,883 | 1/1991 | Ullal et al. | 224/209 |
| 5,077,838 | 1/1992 | Senser | 2/94 |
| 5,114,059 | 5/1992 | Thatcher | 224/216 |
| 5,139,187 | 8/1992 | Fowler | 224/151 |
| 5,240,159 | 8/1993 | Gregory | 224/209 |
| 5,377,887 | 1/1995 | Garcia | 224/151 |

FOREIGN PATENT DOCUMENTS

| | | |
|---|---|---|
| 120642 | 7/1930 | Austria . |
| 2260967 | 9/1975 | France . |

*Primary Examiner*—Henry J. Recla
*Assistant Examiner*—Timothy L. Maust
*Attorney, Agent, or Firm*—Richard C. Litman

[57] ABSTRACT

An article carrier for wearing by a user and modifiable into a plurality of different configurations. This article carrier may be utilized as a fanny pack, a backpack carrier, and/or a carrier for skis and the like. Included in the article carrier is a shoulder harness detachably secured to the fanny pack. This harness may be utilized in conjunction with, or independent from, the fanny pack. When the harness is attached to the fanny pack, it may be entirely stored within the compartment or it may be draped over the user's shoulders. The front surface of the shoulder harness includes a pair of straps, each being adjustably mounted thereto. These straps can be utilized to secure such items as skis, or they can be utilized to removably secure a backpack.

15 Claims, 3 Drawing Sheets

ARTICLE CARRIER

BACKGROUND OF THE INVENTION

1. Field of the Invention

The present invention relates to an article carrier modifiable into a plurality of different configurations. More specifically, the present invention relates to an article carrier usable as a fanny pack, a backpack carrier, and/or a carrier for skis and the like.

2. Description of the Prior Art

Devices for assisting a skier to carry his or her ski equipment are well known in the prior art. In a first type of these devices, the skis are supported by a harness member draped over both shoulders of the user. Patents disclosing carrying devices of this type are U.S. Pat. No. 4,518,107 issued to Jacquelyn V. Amos on May 21, 1985, and U.S. Pat. No. 4,982,883 issued to Pramode N. Ullal on Jan. 8, 1991.

The carrying device disclosed in the Amos patent includes a pliant member for positioning upon a user's back. Extending from this pliant member are a belt for securing around the waist of the user, and a pair of flexible harness straps for looping over the shoulders of the user. To secure skis or the like, two holding straps are fixedly positioned upon the pliant member. The first of these holding straps is positioned at the approximate center of the pliant member, and the second of these holding straps is positioned substantially away from the center of the pliant member. Therefore, the secured skis or other items, are maintained in an angular position relative to the user.

The carrying device disclosed in the Ullal patent is a fanny pack having a two-strap shoulder harness fixedly secured thereto. The central portion of the skis is mounted rigidly to a locator on the fanny pack, and a portion of the skis located vertically above the central portion is secured to one of the shoulder straps by a quick release tie. The ski is maintained in a substantially angled position relative to the user. Included in the fanny pack is a plurality of compartments for carrying ski accessories and the like.

In a second type of ski carrying device, the skis are secured in a tubular tote having a carrying strap extending therefrom. This strap may be clutched by the user, or it may be draped over one of the user's shoulders. To secure the skis within the tote, the ends of the tote are restrictable. Patents disclosing carrying devices of this second type are U.S. Pat. No. 4,792,073 issued to Jeffrey M. Jacober on Dec. 20, 1988, U.S. Pat. No. 5,139,187 issued to David W. Fowler on Aug. 18, 1992, and Austrian Pat. No. 120642 published on Jan. 10, 1931.

None of the above inventions and patents, taken either singly or in combination, is seen to describe the instant invention as claimed.

SUMMARY OF THE INVENTION

The present invention is an article carrier for wearing by a user. This article carrier is modifiable into a plurality of different configurations and it may be utilized as a fanny pack, a backpack carrier, and/or a carrier for skis and the like. The fanny pack portion of the article carrier includes a belt for securing around the waist of a user. It also includes a compartment within which various articles can be stored.

Attachable to the interior of the compartment is a shoulder harness. This harness is detachable from the compartment so that the fanny pack may be utilized independent from, and without, the harness. When the harness is attached to the fanny pack, it may be entirely stored within the compartment or it may be draped over the user's shoulders. The back surface of the shoulder harness includes a pair of straps, each adjustably mounted thereto. These straps can be utilized to secure such items as skis, or they can be utilized to removably secure a backpack.

Accordingly, it is a principal object of the invention to provide a novel article carrier usable as a fanny pack, a backpack carrier, and/or a carrier for skis and the like.

It is another object of the invention to provide a novel article carrier having a removable shoulder harness.

It is a further object of the invention to provide a novel article carrier having a plurality of holding straps adjustably secured to the shoulder harness.

Still another object of the invention is to provide a novel article carrier with a removable backpack.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
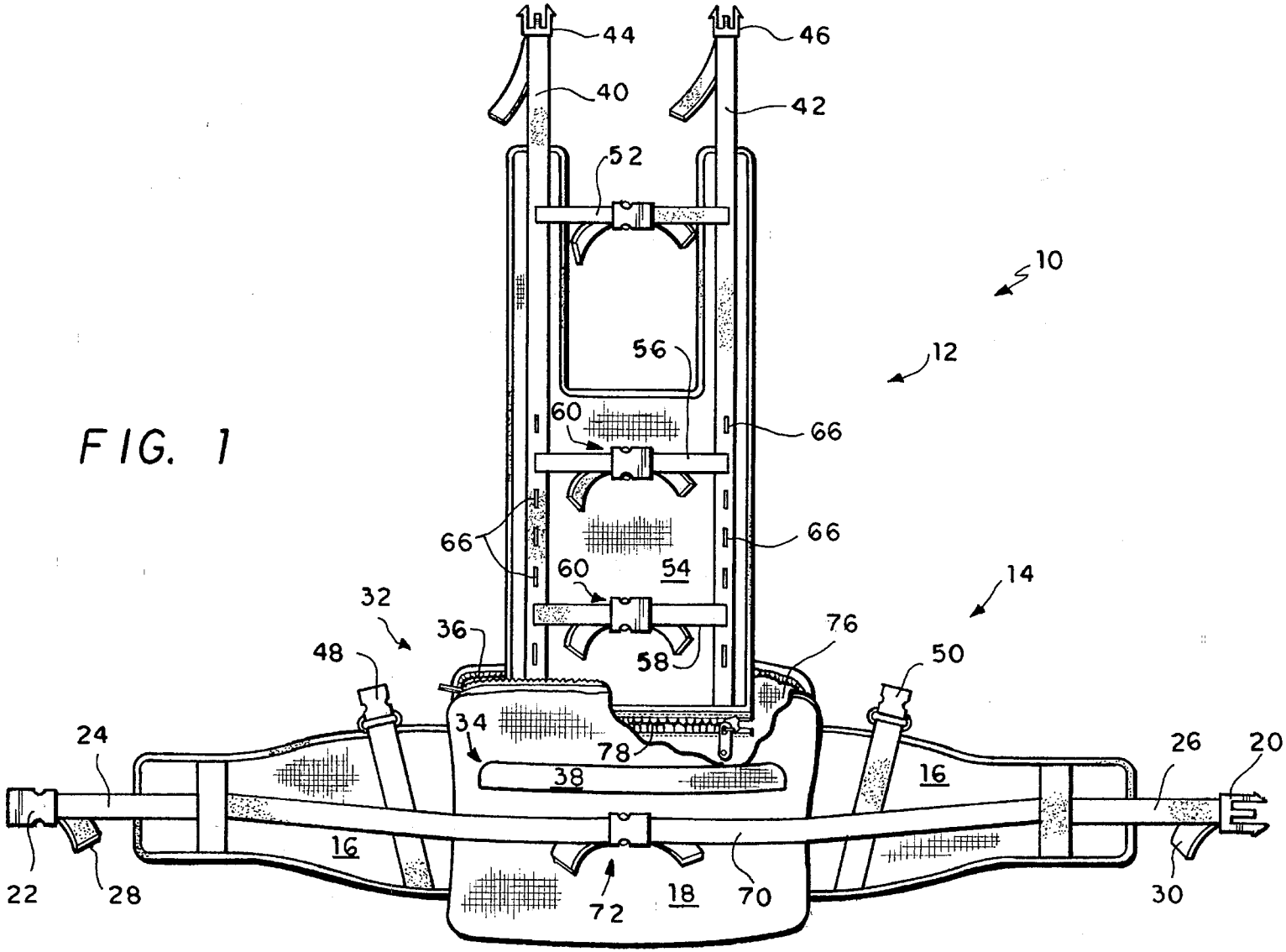
FIG. 1 is a front elevational view, partly in section, of the fanny pack and shoulder harness of the article carrier of the invention.

Referring to FIG. 1, the present invention is an article carrier 10 having a shoulder harness 12 secured to a fanny pack 14. A belt 16 extends from the main body 18 of fanny pack 14, and includes male closure 20 and female closure 22. These closures 20,22 are mateable with each other so that fanny pack 14 may be secured around the waist of a user. To assure that belt 16 can be worn by differently sized individuals, the length of each belt strap 24,26 is adjustable. Belt portions 28,30 are excess slack of belt straps 24,26, respectively. When the size of each belt strap 24,26 is adjusted, the length of each belt portion 28,30 is either increased or decreased, depending upon whether the length of each belt strap 24,26 is made longer or shorter.

Fanny pack 14 includes a first compartment 32 and a second compartment located at 34. First compartment 32 is opened and closed by a zipper 36, and second compartment 34 includes a flap 38 covering its opening. To place articles in, or remove articles from, second compartment 34, flap 38 is displaceable away from the opening of the compartment 34.

Figure 2:
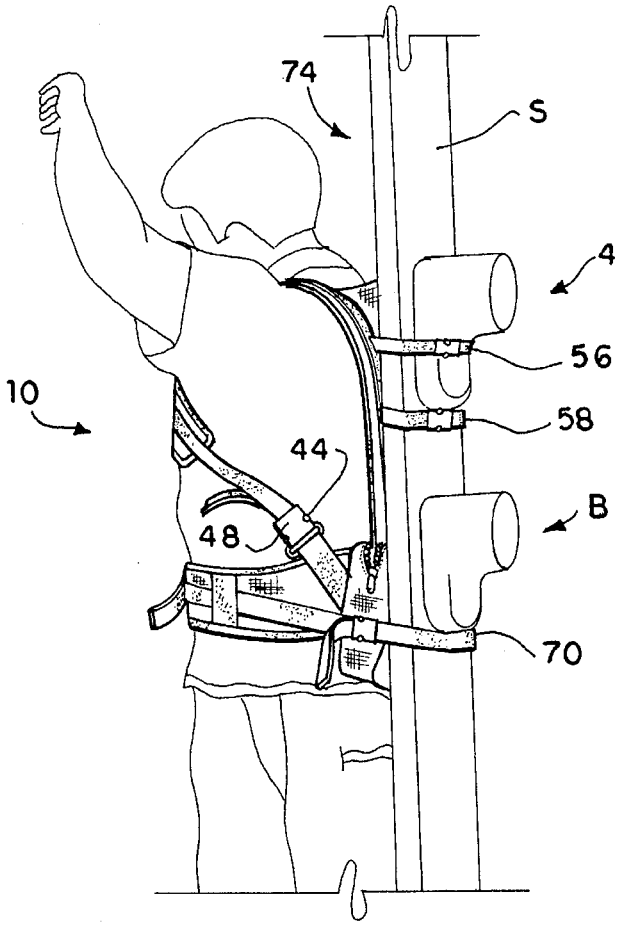
FIG. 2 is an environmental, front perspective view of the fanny pack and shoulder harness shown in FIG. 1, drawn to a reduced scale.
Figure 3:
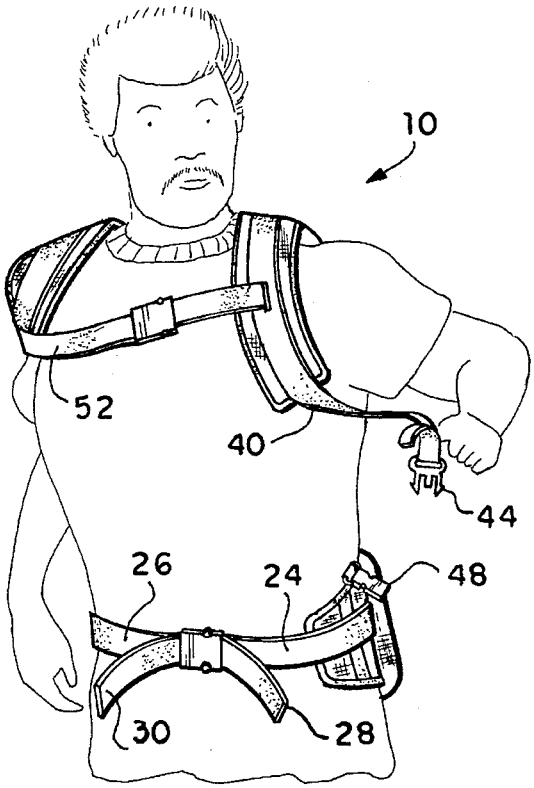
FIG. 3 is an environmental, rear perspective view of the fanny pack and shoulder harness shown in FIG. 1.

As seen in FIGS. 1–3, a pair of straps 40,42 extend from shoulder harness 12, and are for securing shoulder harness 12 upon the shoulders of a user. Each strap 40,42 is draped over a different shoulder of the user. Male closures 44,46 mate with female closures 48,50, respectively, to secure shoulder harness 12 upon the user. Strap 52 is utilized to prevent undesired movement of shoulder harness 12 upon the shoulders of the user, and it has an adjustable length, permitting shoulder harness 12 to be customized to each individual.

As depicted in FIG. 1, shoulder harness 12 includes a front surface 54 having a pair of holding straps 56,58 attached thereto. Each holding strap 56,58 is adjustable in length, and includes a closure 60 having mateable male and female strap components 62,64. Holding straps 56,58 are utilized to secure various items to the harness, and each holding strap 56,58 is movable to any one of the plurality of holding strap acceptors 66 located on front surface 54. Each of these holding strap acceptors 66 accommodates a loop formed within straps 40,42 attached to front surface 54.

The ability to alter the location of each holding strap 56,58 relative to shoulder harness 12 assures that shoulder harness 12 can be utilized to carry items of various dimensions. In FIG. 2, a snowboard S having ski boots A,B is illustrated to be secured to shoulder harness 12. The illustrated placement of holding straps 56,58 upon shoulder harness 12 is such that holding strap 56 securely wraps around the ankle portion of ski boot A, and holding strap 58 securely wraps around an area of snowboard S adjacent to the toe portion of ski boot A. Although holding straps 56,58 could be secured to other locations on shoulder harness 12, the arrangement illustrated in FIG. 2 securely attaches snowboard S to shoulder harness 12.

A third holding strap 70 is utilized to secure snowboard S to article carrier 10. As depicted in FIG. 1, this third holding strap 70 extends from belt 16, has an adjustable length, and has a closure 72 with mateable male and female components. In FIG. 2, third holding strap 70 is illustrated to be securely wrapped around snowboard S at a location adjacent to a toe portion of ski boot B.

That holding strap 70 extends from belt 16, as opposed to the main body 18 of fanny pack 14, provides for maximum stability of article carrier 10 when a large item, such as snowboard S, is secured thereto. Also, the fact that strap 70 extends from diametrically opposed portions of belt 16, assures that belt 16 is capable of securing around extremely wide objects.

Referring to FIG. 2, it can be seen that snowboard S is maintained in a substantially vertical position when secured to article carrier 10. In this position, portion 74 of snowboard S is directly behind the back of the user's head. This minimizes the likelihood that the sharp edges of snowboard S can cause injury to the user by contacting the soft tissue of his or her face.

As a user of article carrier 10 will typically be carrying snowboard S up a hill, it is likely that the user will be leaning forward when carrying snowboard S. When leaning forward, the majority of the weight of snowboard S will be directed onto the user's back. Additionally, the user's head will generally be maintained in a spaced relationship with snowboard S, minimizing the likelihood that the sharp edges of snowboard S can contact the user's head.

Figure 4:
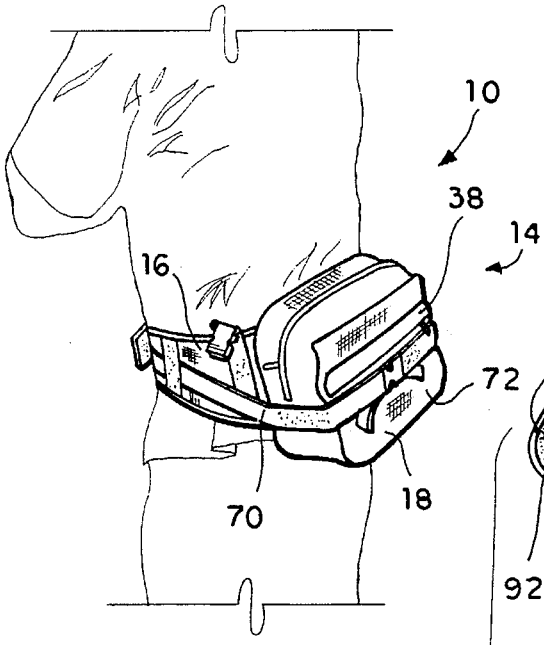
FIG. 4 is an environmental, front perspective view of the fanny pack of the article carrier shown in FIG. 1.

Returning now to FIG. 1, the attachment of shoulder harness 12 to fanny pack 14 is located within compartment 32. Therefore, when shoulder harness 12 is attached to fanny pack 14, shoulder harness 12 may be rolled upon itself, and conveniently stored within compartment 32. When stored in this manner, article carrier 10 can be utilized as a fanny pack, as illustrated in FIG. 4. Various articles, such as ski goggles and the like (not shown) can be stored within compartment 32 along with shoulder harness 12.

A typical use of article carrier 10 is to climb a mountain with snowboard S attached to shoulder harness 12. When it is desired to ski down the mountain, snowboard S is removed from shoulder harness 12, and male closures 44,46 are detached from female closures 48,50. The user then removes shoulder harness 12 from his or her shoulders, and rolls shoulder harness 12 upon itself, until shoulder harness 12 is positioned completely within compartment 32. Zipper 36 is then drawn to close compartment 32, and the user can ski down the mountain with shoulder harness 12 away from his or her shoulders, and secured in a position that will not substantially restrict his or her mobility.

In addition to situations where it is desirable to store shoulder harness 12 within compartment 32, there are situations where it is desirable to utilize fanny pack 14 without shoulder harness 12 attached thereto. As illustrated in FIG. 1, shoulder harness 12 is connected to the interior surface 76 of compartment 32 by a zipper 78, which enables shoulder harness 12 to be detached from fanny pack 14. Therefore, when it is not necessary to utilize shoulder harness 12, fanny pack 14 may be utilized independently from shoulder harness 12, where it is not necessary to store shoulder harness 12 within compartment 32. This maximizes the storage space available within compartment 32.

Figure 5:
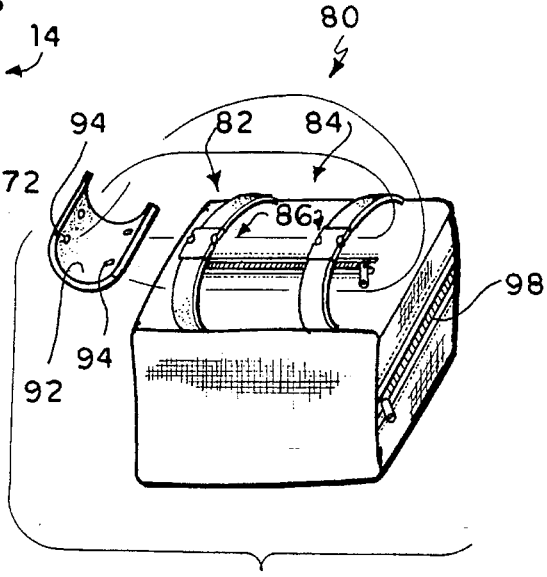
FIG. 5 is a partly exploded, perspective view of the backpack of the invention.
Figure 6:
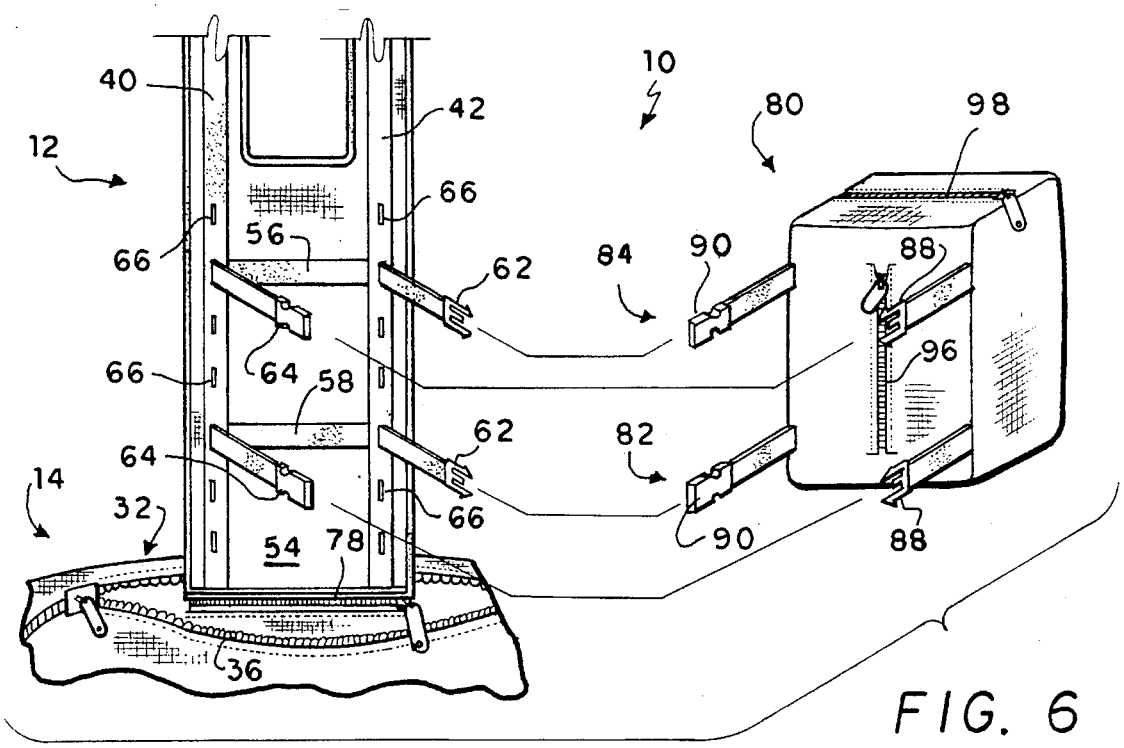
FIG. 6 is a partly exploded, partial perspective view of the fanny pack, shoulder harness, and backpack of the invention.

Still another use of article carrier 10 is illustrated in FIGS. 5 and 6, where a backpack 80 is utilized for additional storage space. As shown in FIG. 5, backpack 80 includes first and second handles 82,84, each having a closure 86 with mateable male and female handle components 88,90 (FIG. 6). When components 88,88 are connected to components 90,90, respectively, handles 82,84 can be conveniently grasped so that backpack 80 can be carried. A flexible member 92 can be wrapped around closures 86,86 so as to insulate the user's hand from the closures 86,86. This flexible member 92 includes conventional snaps 94, utilized to secure member 92 around closures 86,86. Zippers 96,98 permit articles to be placed within, or removed from, the interior of backpack 80. Zipper 96 provides an opening that is easily accessible when backpack 80 is carried by the hand of a user.

When it is not desired to carry backpack 80 by hand, it may be attached to shoulder harness 12, as illustrated in FIG. 6. Male handle components 88,88 are detached from female handle components 90,90. Likewise male strap components 62,62 are detached from female strap components 64,64. Holding straps 56,58 are then moved to suitable holding strap acceptors 66 so that male strap components 62,62 can mate with female handle components 90,90, and female strap components 64,64 can mate with male handle components 88,88. In this manner, holding straps 56,58 can be utilized to secure backpack 80 to shoulder harness 12, as opposed to securing such articles as snowboard S. The adjustable length of each holding strap 56,58 permits for adjustments concerning the distance between front surface 54 and secured backpack 80. With backpack 80 attached, there are storage areas within both backpack 80 and fanny pack 14. For convenience, zipper 98 provides for easy access to the interior of backpack 80.

It is to be understood that the present invention is not limited to the embodiments described above, but encompasses any and all embodiments within the scope of the following claims.

We claim:

1. An article carrier comprising:

a fanny pack including means defining a compartment therein, said compartment having an interior surface;

a shoulder harness detachably secured to said fanny pack at said interior surface, said shoulder harness having a front surface;

a first holding strap securable to said front surface;

said front surface having a plurality of holding strap acceptors, each of said holding strap acceptors configured for the removable attachment of said first holding strap thereto, thereby permitting the interchanging of said first holding strap between a plurality of locations upon said front surface; and a backpack removably securable to said first holding strap.

2. The article carrier according to claim 1, further comprising a second holding strap removably securable to any one acceptor of said plurality of holding strap acceptors, thereby permitting the interchanging of said second holding strap between a plurality of locations upon said front surface.

3. The article carrier according to claim 2, further comprising a backpack removably securable to both said first holding strap and said second holding strap.

4. The article carrier according to claim 1, wherein said fanny pack further comprises a belt portion having a third holding strap extending therefrom.

5. The article carrier according to claim 1, wherein said front surface includes means defining a plurality of loops, each loop of said plurality of loops being one acceptor of said plurality of holding strap acceptors.

6. An article carrier comprising:

a fanny pack;

a shoulder harness secured to said fanny pack, said harness having a front surface;

a first holding strap securable to said front surface, said first holding strap having a first male strap component and a first female strap component mateable with, and separable from, said first male strap component;

said front surface having a plurality of holding strap acceptors, each of said holding strap acceptors configured for the removable attachment of said first holding strap thereto, thereby permitting the interchanging of said first holding strap between a plurality of locations upon said front surface; and a backpack having a first handle, said first handle having a first male handle component and a first female handle component mateable with, and separable from, said first male handle component, said first male handle component being mateable with said first female strap component, said first female handle component being mateable with said first male strap component, thereby permitting for the attachment of said backpack to said first holding strap when said first male strap component is separated from said first female strap component.

7. The article carrier according to claim 6, further comprising a second holding strap removably securable to any one acceptor of said plurality of holding strap acceptors, thereby permitting the interchanging of said second holding strap between a plurality of locations upon said front surface, said second holding strap having a second male strap component and a second female strap component mateable with, and separable from, said second male strap component.

8. The article carrier according to claim 7, further comprising a backpack having:

a first handle, said first handle having a first male handle component and a first female handle component mateable with, and separable from, said first male handle component, said first male handle component being mateable with said first female strap component, said first female handle component being mateable with said first male strap component, thereby permitting for the attachment of said backpack to said first holding strap when said first male strap component is separated from said first female strap component; and a second handle, said second handle having a second male handle component and a second female handle component mateable with, and separable from, said second male handle component, said second male handle component being mateable with said second female strap component, said second female handle component being mateable with said second male strap component, thereby permitting for the attachment of said backpack to said second holding strap when said second male strap component is separated from said second female strap component.

9. The article carrier according to claim 6, wherein said front surface includes means defining a plurality of loops, each loop of said plurality of loops being one acceptor of said plurality of holding strap acceptors.

10. An article carrier comprising:

a fanny pack having a belt portion;

a shoulder harness secured to said fanny pack, said shoulder harness having a front surface;

a first holding strap securable to said front surface, said front surface having a plurality of holding strap acceptors, each of said holding strap acceptors configured for the removable attachment of said first holding strap thereto, thereby permitting the interchanging of said first holding strap between a plurality of locations upon said front surface;

a backpack removably securable to said first holding strap; and a third holding strap extending from said belt portion.

11. The article carrier according to claim 10, further comprising a second holding strap removably securable to any one acceptor of said plurality of holding strap acceptors, thereby permitting the interchanging of said second holding strap between a plurality of locations upon said front surface.

12. The article carrier according to claim 11, wherein said backpack is attachable to said second holding strap.

13. The article carrier according to claim 10, wherein said shoulder harness is detachable from said fanny pack.

14. The article carrier according to claim 10, wherein said fanny pack includes means defining a compartment therein, said compartment having an interior surface, said shoulder harness being secured to said fanny pack at said interior surface.

15. The article carrier according to claim 14, further comprising means for detachably connecting said fanny pack to said shoulder harness.

* * * * *